US011543154B2

(12) United States Patent
Robbin et al.

(10) Patent No.: US 11,543,154 B2
(45) Date of Patent: Jan. 3, 2023

(54) DEVICE, SYSTEM, AND METHOD FOR CONTROLLING THE TEMPERATURE OF WORKPIECES

(71) Applicant: EISENMANN SE, Böblingen (DE)

(72) Inventors: Jörg Robbin, Ammerbuch-Pfäffingen (DE); Mischa Wittek, Gechingen (DE); Herbert Schulze, Aidlingen (DE)

(73) Assignee: EISENMANN GMBH, Böblingen (DE)

( * ) Notice: Subject to any disclaimer, the term of this patent is extended or adjusted under 35 U.S.C. 154(b) by 0 days.

(21) Appl. No.: 16/317,680

(22) PCT Filed: Jul. 14, 2017

(86) PCT No.: PCT/EP2017/067818
§ 371 (c)(1),
(2) Date: Jan. 14, 2019

(87) PCT Pub. No.: WO2018/011389
PCT Pub. Date: Jan. 18, 2018

(65) Prior Publication Data

US 2019/0219304 A1 Jul. 18, 2019

(30) Foreign Application Priority Data

Jul. 15, 2016 (DE) ..... 10 2016 113 062.1

(51) Int. Cl.
*F27B 9/10* (2006.01)
*F24H 9/00* (2022.01)
(Continued)

(52) U.S. Cl.
CPC ..... *F24H 9/0057* (2013.01); *F26B 3/283* (2013.01); *F26B 15/14* (2013.01); *F26B 15/16* (2013.01);
(Continued)

(58) Field of Classification Search
CPC .. F27B 9/028; F27B 9/02; F27B 9/029; F27B 9/14; F27B 9/10; F27B 13/02; C21D 9/0043; C21D 9/0056; F27D 2003/0034
See application file for complete search history.

(56) References Cited

U.S. PATENT DOCUMENTS 3,556,013 A 1/1971 Kruer et al.
4,299,036 A * 11/1981 Schregenberger ..... F27B 9/28 34/210
(Continued)

FOREIGN PATENT DOCUMENTS

CN 102 906 521 1/2013
CN 103 097 234 5/2013
(Continued)

*Primary Examiner* — Gregory A Wilson
(74) *Attorney, Agent, or Firm* — Schroeder Intellectual Property Law Group, LLC

(57) ABSTRACT

A device for controlling the temperature of workpieces, in particular for drying vehicle bodies, having a housing, a temperature-controlling tunnel accommodated in the housing, and a temperature-controlling system for controlling the temperature of workpieces. The temperature-controlling system includes a full-space temperature-controlling device which can control the temperature of a workpiece as a whole, and a local temperature-controlling device which can control the temperature of locally delimited regions of the workpiece and which comprises multiple temperature-controlling units that can be activated and actuated independently of one another for this purpose. The full-space temperature-controlling device and the local temperature-controlling device are provided in the temperature-controlling tunnel such that a workpiece at least within an active section in the temperature-controlling tunnel can be under the influence of both the full-space temperature-controlling device as well as the local temperature-controlling device. A
(Continued)

system and a method for controlling the temperature of workpieces are additionally provided.

14 Claims, 8 Drawing Sheets

(51) Int. Cl.

| | |
|---|---|
| ***F26B 3/28*** | (2006.01) |
| ***F26B 15/14*** | (2006.01) |
| ***F26B 15/16*** | (2006.01) |
| ***F26B 25/10*** | (2006.01) |
| ***F26B 25/12*** | (2006.01) |

(52) U.S. Cl.
CPC ..... *F26B 25/10* (2013.01); *F26B 25/12* (2013.01); *F26B 2210/12* (2013.01)

(56) References Cited

U.S. PATENT DOCUMENTS

| | | | | |
|---|---|---|---|---|
| 4,416,068 | A * | 11/1983 | Nilsson | B05D 3/0263 118/642 |
| 4,688,180 | A * | 8/1987 | Motomiya | F27B 9/029 432/11 |
| 5,456,023 | A * | 10/1995 | Farnan | F26B 21/004 34/270 |
| 8,997,374 | B2 * | 4/2015 | Sato | F26B 3/283 34/270 |
| 9,688,478 | B2 | 6/2017 | Robbin | |
| 9,890,996 | B2 | 2/2018 | Hihn et al. | |
| 10,060,676 | B2 | 8/2018 | Hihn | |
| 10,184,722 | B1 * | 1/2019 | Ingle | F26B 3/283 |
| 10,533,797 | B2 * | 1/2020 | Sluka | F26B 3/04 |
| 2007/0261264 | A1 | 11/2007 | Ortlieb et al. | |
| 2007/0272150 | A1 * | 11/2007 | Swoboda | F26B 3/28 118/642 |
| 2011/0131828 | A1 | 6/2011 | Swoboda | |
| 2013/0061489 | A1 | 3/2013 | Sato | |
| 2013/0199893 | A1 | 8/2013 | Robbin | |
| 2013/0312277 | A1 | 11/2013 | Hihn | |
| 2018/0120028 | A1 | 5/2018 | Robbin | |

FOREIGN PATENT DOCUMENTS

| | | |
|---|---|---|
| CN | 103 380 343 | 10/2013 |
| DE | 10 2010 007 412 | 8/2011 |
| DE | 10 2011 011 261 | 8/2012 |
| DE | 10 2011 117 666 | 5/2013 |
| DE | 10 2015 006 098 | 11/2016 |
| JP | H01210076 | 8/1989 |

* cited by examiner

DEVICE, SYSTEM, AND METHOD FOR CONTROLLING THE TEMPERATURE OF WORKPIECES

RELATED APPLICATIONS

This application is a national phase of International Patent Application No. PCT/EP2017/067818 filed Jul. 14, 2017, which claims priority to German Patent Application No. 10 2016 113 062.1 filed Jul. 15, 2016—the contents of both of which are incorporated herein by reference.

FIELD OF THE INVENTION

The invention relates to a device for controlling the temperature of workpieces, in particular for drying vehicle bodies, said device having a) a housing;

b) a temperature-controlling tunnel accommodated in the housing;

c) a temperature-controlling system for controlling the temperature of the workpieces.

The invention moreover relates to a system and to a method for controlling the temperature of workpieces.

BACKGROUND OF THE INVENTION

When "controlling the temperature" of a vehicle body is presently discussed, this herein means making available a specific temperature of the vehicle body which the latter initially does not yet have. This can be an increase in temperature or a decrease in temperature. A "temperature-controlled air" is understood to be air which has the temperature required for controlling the temperature of the vehicle body. This generally applies in analogous manner to workpieces of all types.

A case of controlling temperature that often arises in the automotive industry, specifically the heating of the vehicle bodies, is the procedure of drying the coating of a vehicle body, be it a paint or an adhesive or the like, or else the drying of a moist or wet surface of the workpiece. The detailed description hereunder of the invention is performed using the example of such drying.

When "drying" is presently discussed, this thus in the drying of coatings refers in particular to procedures in which the coating of the vehicle body, in particular a paint, can be brought to cure, be it by evacuating solvents or by cross-linking the coating substance.

Vehicle bodies in terms of the construction thereof have become increasingly complicated in recent times. In particular, said vehicle bodies have dissimilar masses in different regions. For example, the lowermost region, the sill region, or the floor group, is thus heavy in terms of mass and consequently has a significant thermal capacity. When heating the various regions of the vehicle body a not insignificant time is required until the heat has fully penetrated said regions. Moreover, said time differs in a localized manner, depending on how the distribution of mass and the distribution of the thermal capacities currently are in the respective region. The B pillar or regions on the roof rail are further examples of regions of a vehicle body which predefine dissimilar thermal capacities and set dissimilar requirements for a drying procedure.

Known devices designed as dryers of the type mentioned at the outset usually have a temperature-controlling zone in the temperature-controlling tunnel in which the vehicle body as an entity is heated to a desired temperature. To this end, in each case one pressurized chamber can be present on both sides of the temperature-controlling zone, for example; by way of said pressurized chambers temperature-controlled air can be dispensed through nozzles onto the external face and optionally also onto the internal face of the vehicle body.

In the case of such known devices and methods the vehicle body as an entity by way of the temperature-controlling device is temperature-controlled overall over a specific temporal duration. However, by virtue of the dissimilar masses of the body parts, regions or parts of the vehicle body can have dissimilar temperatures which in the case of many parts can also be below the required minimum temperature for an ideally optimal drying procedure, even when other regions and parts of the vehicle body already have the required nominal temperature or even exceed the latter.

The dwell time of the vehicle body to be dried in the dryer is however typically adapted to the longest time which the most unfavorable region of the vehicle body that has the heaviest mass requires the drying. On account thereof, not only are the cycle times of the dryer extended; moreover, overheating can take place in those regions and on those parts of the vehicle body which dry more rapidly. This can have a particularly disadvantageous effect where dissimilar and also temperature-sensitive materials are installed in the vehicle body and/or adhesive bonding has taken place.

In order to counteract the above, it is known, for example from DE 10 2011 117 666 A1, for a pre-temperature-controlling zone to be disposed upstream in the transport direction of a temperature-controlling zone in which the temperature of workpiece as an entity is controlled, and/or a post-temperature-controlling zone to be disposed downstream in the transport direction of said temperature-controlling zone in which the temperature of the workpiece as an entity is controlled, a local temperature-controlling installation is respectively disposed in said pre-temperature-controlling zone and/or said post-temperature-controlling zone by means of which said local temperature-controlling installation the temperatures of locally delimited regions of the workpiece are able to be controlled in a targeted manner.

However, said temperature-controlling device on account of the local temperature-controlling installation requires additional installation space, and the system overall becomes more complex.

SUMMARY OF THE INVENTION

It is therefore an object of the invention of achieving a device, system, and a method of the type mentioned at the outset which take into account said ideas.

This object in the case of a device of the type mentioned at the outset is achieved in that d) the temperature-controlling system comprises:

- da) a full-space temperature-controlling installation by means of which the temperature of a workpiece as an entity can be controlled;
- db) a local temperature-controlling installation by means of which the temperatures of locally delimited regions of the workpieces are capable of being controlled in a targeted manner, said local temperature-controlling installation to this end comprising a plurality of temperature-controlling units that are capable of being activated and actuated in a mutually independent manner;

wherein e) the full-space temperature-controlling installation and the local temperature-controlling installation are provided in the temperature-controlling tunnel in such a manner that a workpiece at least within an effective portion in the temperature-controlling tunnel can be under the influence of both the full-space temperature-controlling installation as well as the local temperature-controlling installation.

It has been acknowledged according to the invention that the temperature of the workpiece and in particular of a vehicle body can be controlled, or said workpiece can be dried, respectively, in a particularly effective manner when the local temperature-controlling installation supports and accelerates the drying of mass-rich regions of the workpiece, while the temperature of the workpiece as an entity is simultaneously controlled, or said workpiece as an entity is dried, respectively, by a type of superordinate full-space temperature-controlling installation. In the drying of workpieces it is possible in this way that such mass-rich regions are rendered dry largely simultaneously with the remaining, less mass-rich regions of the workpiece. The installation space required for the temperature-controlling device herein can be kept so as to be comparatively small in comparison to the known device.

It is favorable when the full-space temperature-controlling installation comprises at least one air space which is separated from the temperature-controlling tunnel by way of a wall having air passages, wherein the air is capable of being blown into the drying tunnel from the at least one air space. In this way, the drying tunnel can be brought to an operating temperature in an effective manner such that the same temperature prevails in a largely homogenous and uniform manner in the drying tunnel.

Depending on the configuration and disposal of the local temperature-controlling installation herein it is advantageous when an air space is disposed laterally beside the temperature-controlling tunnel, or two air spaces are disposed on both sides beside the temperature-controlling tunnel, and/or an air space is disposed above the temperature-controlling tunnel.

In terms of the local temperature-controlling installation it is advantageous for the latter to comprise stationary temperature-controlling units and/or repositionable temperature-controlling units.

At least one of the temperature-controlling units of the local temperature-controlling installation is preferably movable such that the main jet direction thereof is adjustable. The main jet direction herein is to be defined has that direction in which a temperature-controlling unit develops the greatest effect thereof.

At least one movable temperature-controlling unit preferably comprises a pivotable nozzle strip and/or at least one movable temperature-controlling unit comprises a robotic arm.

The temperature of a local region of the workpiece can be effectively controlled when the robotic arm supports an air nozzle. Other heating installations are however also conceivable, as will yet be explained hereunder.

The above-mentioned object in the case of a system of the type mentioned at the outset is achieved in that a device having some or all of the above-explained features is present.

A transport system which comprises a multiplicity of transport trucks which are repositionable on a rail system and by means of which the workpieces are capable of being transported in or through the temperature-controlling tunnel of the device is particularly preferably present, wherein each transport truck comprises a transport-truck running gear and a fastening installation for at least one workpiece, said transport-truck running gear and said fastening installation being coupled to one another by means of a connection installation.

A good shielding of the drive components of the transport trucks is possible when the temperature-controlling tunnel has a tunnel floor having a connection passage and a running space, disposed below the temperature-controlling tunnel, for the transport-truck running gear is present in such a manner that the transport-truck running gear is movable in the running space, wherein the fastening installation is carried onboard in the temperature-controlling tunnel, and the connection installation extends through the connection passage.

With a view to individual drying procedures for different workpieces it is advantageous when the transport trucks carry onboard a dedicated drive system such that the transport trucks are capable of being driven and repositioned in a mutually independent manner.

The transport trucks particularly preferably carry onboard an autonomous power supply installation by means of which the drive system is capable of being supplied with power.

The temperature of different workpieces can be effectively controlled when at least two devices for controlling the temperature of the workpieces in terms of conveying technology are linked in parallel or in series by the transport system.

The above-mentioned object in the case of a method for controlling the temperature of workpieces is achieved in that the temperature of workpieces is controlled at least in one effective portion of a temperature-controlling tunnel both by means of a full-space temperature-controlling installation by means of which the temperature of the workpiece as an entity can be controlled, as well as by means of a local temperature-controlling installation by means of which the temperatures of locally delimited regions of the workpieces are capable of being controlled in a targeted manner, said local temperature-controlling installation to this end comprising a plurality of temperature-controlling units which are capable of being activated and actuated in a mutually independent manner.

BRIEF DESCRIPTION OF THE DRAWINGS

Exemplary embodiments of the invention will be explained in more detail hereunder by means of the drawings in which.

DETAILED DESCRIPTION OF THE INVENTION

Figure 1:
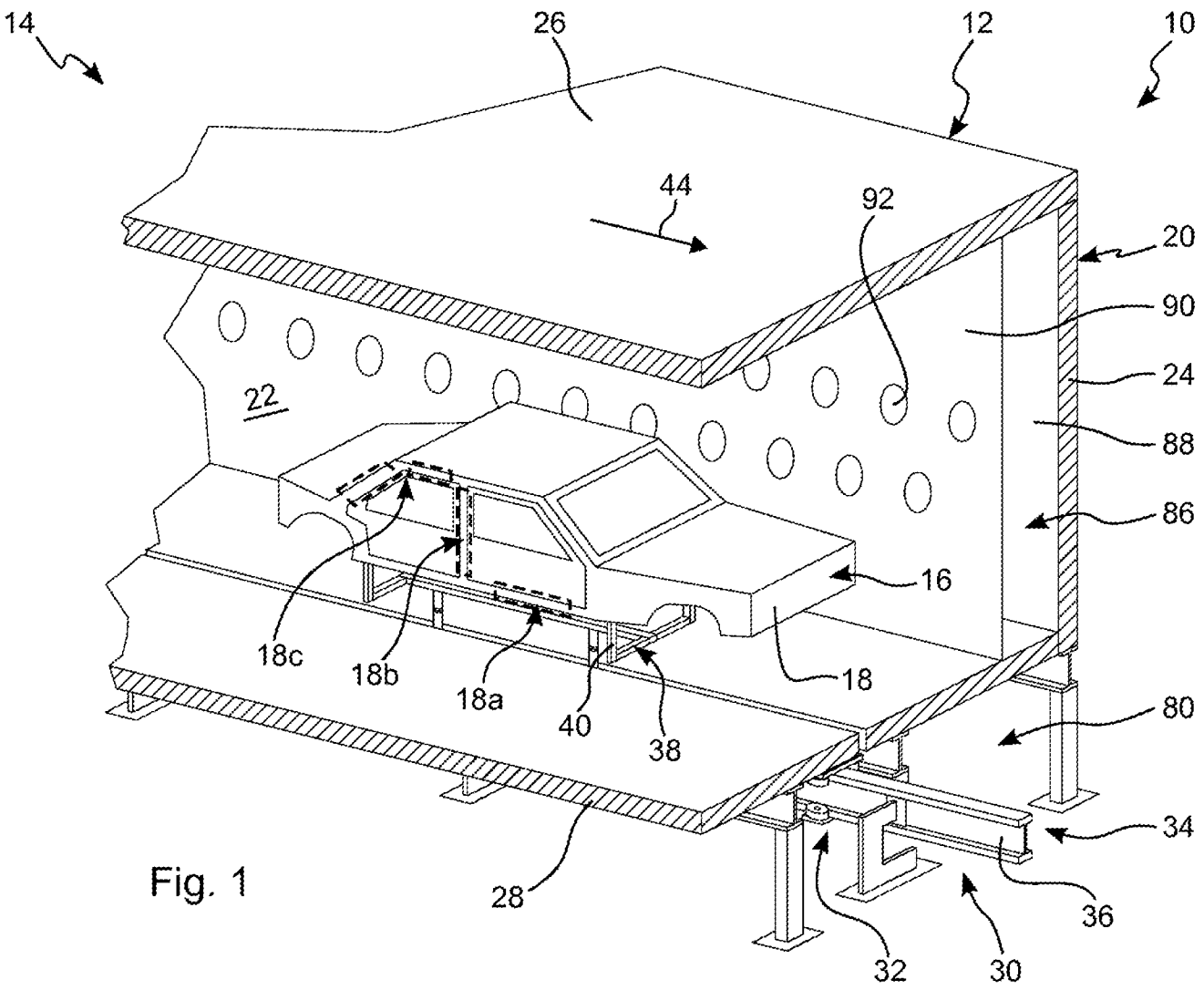
FIG. 1 shows a perspective partial section of a drying cabin of a dryer for drying workpieces, wherein a full-space temperature-controlling installation and a local temperature-controlling installation are provided in the drying cabin.

FIG. 1 shows a perspective partial section of the temperature-controlling device 10 in the form of the dryer having a drying cabin 12 of a system for controlling the temperature of workpieces 16, said system being identified as an entity by the reference sign 14. Vehicle bodies 18 are in each case shown as examples of workpieces 16 in FIGS. 1, 2, and 3 to 8. However, said workpieces 16 can also be other workpieces and in particular be add-on or superstructure parts of vehicle bodies 18, such as bumpers, side mirrors, or the like. Smaller workpieces 16 can optionally be disposed on a workpiece carrier (not specifically shown).

As has been discussed at the outset, workpieces 16 have mutually dissimilar regions having dissimilar thermal capacities, said regions in each case setting specific requirements for a temperature-controlling procedure. Regions of this type in FIG. 1 are identified by the reference signs 18*a*, 18*b*, and 18*c* and in the case of the present exemplary embodiment define the sill region 18*a*, the B-pillar region 18*b*, and roof-rail regions 18*c* of a vehicle body 18.

The drying cabin 12 comprises a cabin housing 20 which as a temperature-controlling tunnel delimits a drying tunnel 22 and comprises side walls 24, a ceiling 26, and a tunnel floor 28.

Figure 2:
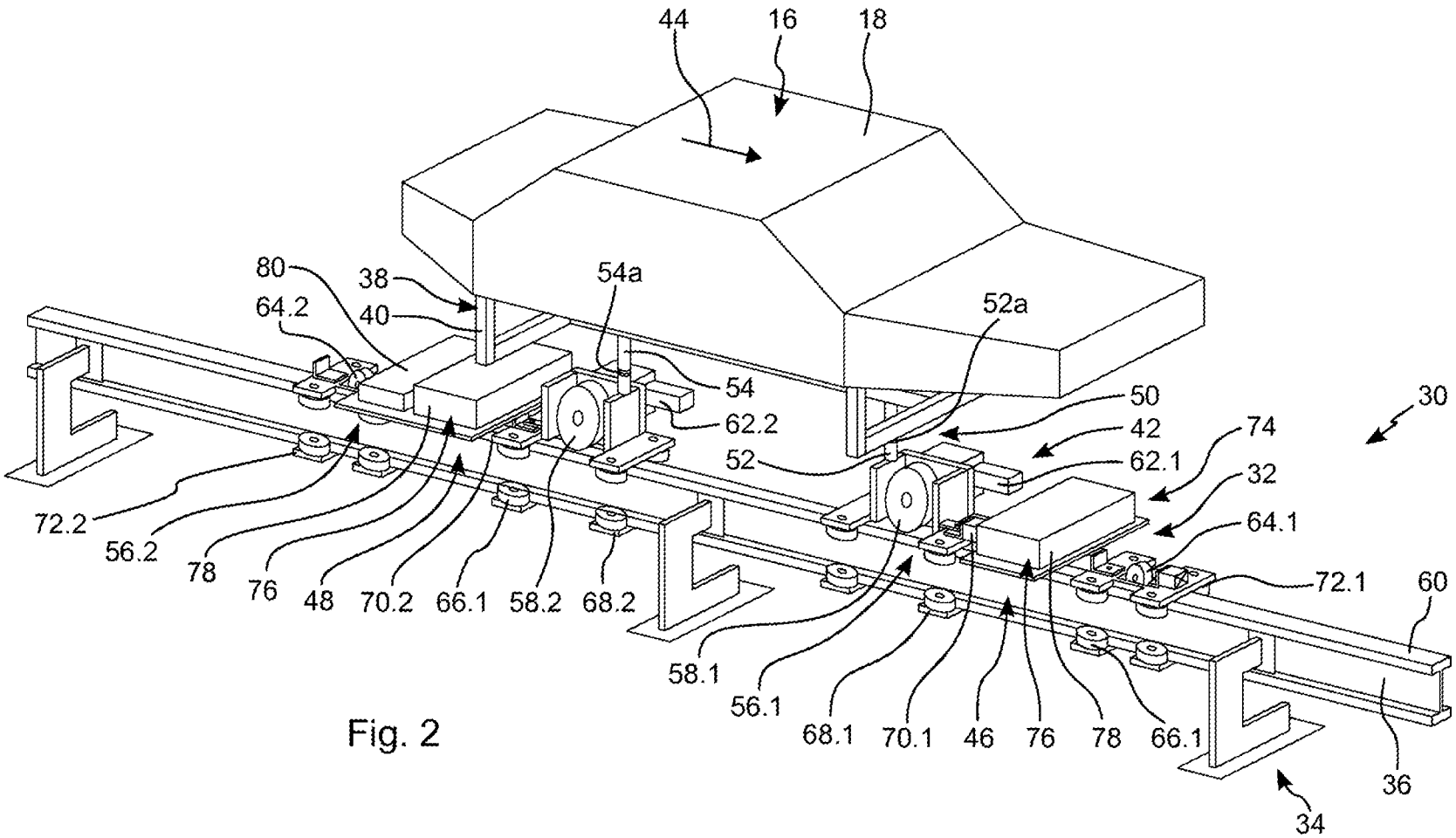
FIG. 2 shows a perspective view of a transport system for the dryer as per FIG. 1.

The dryer 14 comprises a transport system 30 by means of which the workpieces 16 are transported through the drying cabin 12 and which will now be described by means of FIG. 2. The transport system 30 comprises a multiplicity of transport trucks 32 on which the workpieces 16 are transported and which are repositioned on a rail system 34. The rail system 34 of the transport system 30 comprises a support rail 36 on which the transport trucks 32 are repositioned and which in the case of the present exemplary embodiment is configured as a I-profile and is anchored to the floor in a manner known per se. The thus floor-bound support rail 36 is single-track. Alternatively, a multi-track, in particular double-track, rail system 34 can also be present.

A transport truck 32 comprises a fastening installation 38 to which a vehicle body 18 or a corresponding workpiece carrier for workpieces 16 can be fastened. The fastening installation 38 in the case of the present exemplary embodiment is conceived for receiving vehicle bodies 18. To this end, the fastening installation 38 comprises a support profile 40 having mounting bolts (not visible in the figures) which in a manner known per se interact with counter elements on the vehicle body 18 such that the vehicle body 18 can be fixed to the fastening installation 38. The fastening installation 38 can also have a plurality of sets of such mounting bolts which are adapted to different vehicle bodies 18 having dissimilar dimensions and design embodiments, such that the fastening installation 38 can be flexibly utilized for different types of vehicle bodies.

The fastening installation 38 first directly receives a vehicle body 18. In the case of another conveying concept the vehicle body 18 in a manner known per se is fastened onto a so-called skid which then conjointly with the vehicle body 18 is attached to the fastening installation 38.

The transport truck 32 comprises a transport-truck running gear 42 which runs on the support rail 36 and mounts the fastening installation 38. The transport-truck running gear 42 in the case of the present exemplary embodiment comprises a leader unit 46 which leads in the transport direction 44, and a follower unit 48 which trails in the transport direction 44. The transport direction 44 is indicated by an arrow only in FIGS. 1 and 2.

The leader unit 46 and the follower unit 48, that is to say the transport-truck running gear 42 in general, are coupled to the fastening installation 38 by way of a connection installation 50. The coupling is specified in such a manner that the transport truck 32 is capable of also negotiating curved portions of the support rail 36. The connection installation 50 in the case of the present exemplary embodiment comprises two vertical articulated stays 52 and 54, respectively, which couple the leader unit 46 and the follower unit 48 to the fastening installation 38. The articulated stays 52, 54 by way of a joint 52*a*, 54*a*, respectively, enable the fastening installation 38 to pivot about a vertical rotation axis in relation to the leader unit 46 and the follower unit 48.

The leader unit 46 and the follower unit 48 are largely of identical construction, wherein individual parts and components on a straight portion of the support rail 36 are mirrored in relation to a plane perpendicular to the transport direction 44. Mutually corresponding parts and components of the leader unit 46 and of the follower unit 48 have the same reference signs with the indices "0.1" or "0.2", respectively. The leader unit 46 forms a running-gear unit 56.1, and the follower unit 48 forms a running-gear unit 56.2 of the transport-truck running gear 42 of the transport truck 32.

The leader unit 46 will now be explained hereunder; the same applies in analogous manner to the follower unit 48. The leader unit 46 mounts a drive roller 58.1 which rolls on a drive raceway 60 of the support rail 36 and is driven by means of a drive motor 62.1 which is carried onboard by the leader unit 46. The drive raceway 60 of the support rail 36 in the case of the present exemplary embodiment is the face on the upper side of the I-profile and correspondingly runs likewise horizontally in horizontal portions of the support rail 36. In the case of modifications (not specifically shown) the drive raceway 60 can also run vertically, for example; in this case, the drive roller 58.1 as a friction wheel presses laterally against the support rail 36.

In general terms, the transport trucks 32 carry in each case on-board a dedicated drive system such that the transport trucks 32 can be driven and repositioned in a mutually independent manner. The dedicated drive system in the case of the present exemplary embodiment is configured by the drive rollers 58.1, 58.2 and the associated drive motors 62.1, 62.2.

Besides the transport trucks 32 explained here, having a dedicated drive system, other transport trucks which are driven by a central drive system can optionally also be present. For example, such a central drive system can be configured by a chain drive or the like. The transport trucks 32 explained here can accordingly also be driven and repositioned independently of other drive installations.

In order to prevent the leader unit 46 from tilting in the transport direction 44, that is to say tilting about a horizontal axis perpendicular to the transport direction 44, the running-gear unit 56.1 of the leader unit 46 mounts a passive support roller 64.1 which is spaced apart from the drive roller 58.1 and which likewise rolls on the drive raceway 60 of the support rail 32. Moreover, the running-gear unit 56.1 of the leader unit 46 mounts a plurality of lateral guide rollers 66.1 of which only two have a reference sign and which bear from both sides on the support rail 36 and thus in the manner known per se prevent any sideways tilting of the leader unit 46, and of which only two have a reference sign.

The leader unit 46 in the case of the present exemplary embodiment comprises a drive frame 68.1 which mounts the drive roller 58.1 having the drive motor 62.1 and in each case four guide rollers 66.1 on both sides of the support rail 36. The drive frame 68.1 by way of a support cross beam 70.1 is connected in an articulated manner to a support frame 72.1 which in turn mounts the support roller 64.1 and likewise in each case four guide rollers 66.1 on both sides of the support rail 36. The articulated connection of the drive frame 68.1 to the support frame 72.1 is performed by way of coupling joints (not specifically provided with a reference sign) which allow curved portions of the support rail 36 to be negotiated.

In the case of the present exemplary embodiment, both the leader unit 46 as well as the follower unit 48 mount in each case one drive roller 58.1 and 58.2, respectively, as well as the respective associated drive motor 62.1, 62.2. In the case of a modification (not specifically shown) it can suffice for a drive roller 58.1 having a drive motor 62.1 to be present only on the leader unit 46. The transport-truck running gear 42 of the transport truck 32 in any case mounts at least one drive roller and carries the drive motor thereof on-board.

The transport truck 32 carries on board an autonomous power supply installation 74 for the supply of power to the drive motors 62.1 and 62.2 of the leader unit 46 and of the follower unit 48. This is to be understood to be a power supply installation which ensures the supply of power to the drive system, presently to the drive motors 62.1, 62.2 in the travelling operation, that is to say during the movement of the transport truck 32, in a manner independent of external power sources.

The power supply installation 74 having rechargeable power accumulators 76 in the case of the present exemplary embodiment is conceived so as to have at least one power accumulator unit 78. One energy accumulator 78 for the respective drive motor 62.1, 62.2 here in is present on each running-gear unit 56.1, 56.2. A rechargeable energy accumulator unit 78 for electric power can be provided in the form of a battery or a capacitor. In the case of a modification (not specifically shown) a single power accumulator unit can also be provided for both drive motors 62.1, 62.2. Alternatively, compressed gas accumulators can also be present as power sources for compressed-gas drives.

The follower unit 48 moreover supports a control installation 80 by means of which the drive motors 62.1, 62.2 are actuated and synchronized. The control installation 80 communicates with a central controller of the dryer 14 (not specifically shown).

The tunnel floor 28 of the drying cabin 12 now has a connection passage 82 which is complementary to the connection installation 50 of the transport trucks 32 and which leads to a running space 84 for the transport-truck running gear 42 which is disposed below the drying tunnel 22 and in which the rail system 34 is accommodated.

When a transport truck 32 loaded with the workpiece 16 enters the drying cabin 12, the connection installation 50 of the transport truck 32 is thus threaded into the connection passage 82 of the tunnel floor 28, so to speak. When the workpieces 16 are then conveyed through the drying tunnel 22, the transport-truck running gear 42 moves in the running space 84 and carries the fastening installation on board in the drying tunnel 22, wherein the connection installation 50, that is to say in the case of the present exemplary embodiment the articulated stays 52 and 54, extend through the connection passage 82 in the tunnel floor 28.

In order for the tunnel atmosphere not to be able to flow unimpeded from the drying tunnel 22 downward through the connection passage 82 into the running space 84 and in order for such an outflow of the tunnel atmosphere from the drying tunnel 22 to at least to be rendered more difficult, the connection passage 82 can be configured so as to be a type of labyrinth seal. Alternatively or additionally, flexible sealing means or shielding means can be provided on the connection passage 82, this however not being discussed in detail here.

The drying cabin 12 comprises a full-space temperature-controlling device 86 by means of which the temperature of the workpiece as an entity can be controlled. The full-space temperature-controlling device 86 thus acts in such a manner that a largely uniform and homogenous heating effect is exerted on all regions of the workpiece 16 in the drying cabin 12 there where the workpiece 16 is located, in as far as this can be implemented in technical terms. In other words, the full-space temperature-controlling installation 86 ensures that the workpiece 16 is exposed in a largely uniform and homogenous manner to the same temperature.

To this end, the drying cabin 12 comprises air spaces 88 which are accommodated on both sides beside the drying tunnel 22 in the cabin housing 20. The air spaces 88 and the drying tunnel 22 are separated by vertical intermediate walls 90 in which corresponding air passages 92 are present, of which only one has a reference sign. Hot and pre-conditioned, in particular dried, air is blown in a manner known per se from the air spaces 88 through the air passages 92 into the drying tunnel 22. On account thereof, a specific temperature is set in a largely uniform and homogenous manner in the drying tunnel 22. Alternatively or additionally, the air passages 92 can optionally be provided with movable and adjustable nozzles and/or filters.

The drying cabin 12 moreover comprises a local temperature-controlled installation 94 with the aid of which the temperatures of locally delimited regions of the workpiece 16 are capable of being controlled in a targeted manner. To this end, the local temperature-controlling installation 94 comprises a plurality of temperature-controlling units which are capable of being activated and actuated in a mutually independent manner and which in general are identified by the reference sign 96 and in detail are identified by the reference sign 96 with the addition of an index "0.1", "0.2", etc.

The full-space temperature-control installation 86 and the local temperature-controlling 94 conjointly form a temperature-controlling system 86, 94 of the temperature-controlling device 10, or of the drying cabin 12, respectively.

The full-space temperature-controlling installation 86 and the local temperature-controlling installation 94 are provided in the drying cabin 12 in such a manner that the workpiece 16 within an effective portion 98 in the drying tunnel 22 can be under the influence of both the full-space temperature-controlling installation 86 as well as the local temperature-controlling installation 94. The full-space temperature-controlling installation 86 and the local temperature-controlling installation 94 herein can be adjusted so as to be mutually adapted in particular in such a manner that all regions of the workpiece 16 are rendered dry largely at the same point in time. In terms of drying a vehicle body 18 this means that the local temperature-controlling installation 94 supports and accelerates the drying of the mass-rich regions 18*a*, 18*b*, 18*c* of the vehicle body 18 in such a manner that said regions are rendered dry largely simultaneously with the remaining, less mass-rich regions of the vehicle body 18.

Figure 3A:
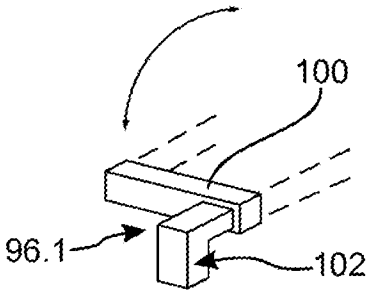
FIG. 3A shows a detailed view of a first local temperature controlling unit having a pivotable temperature-controlling strip.
Figure 3:
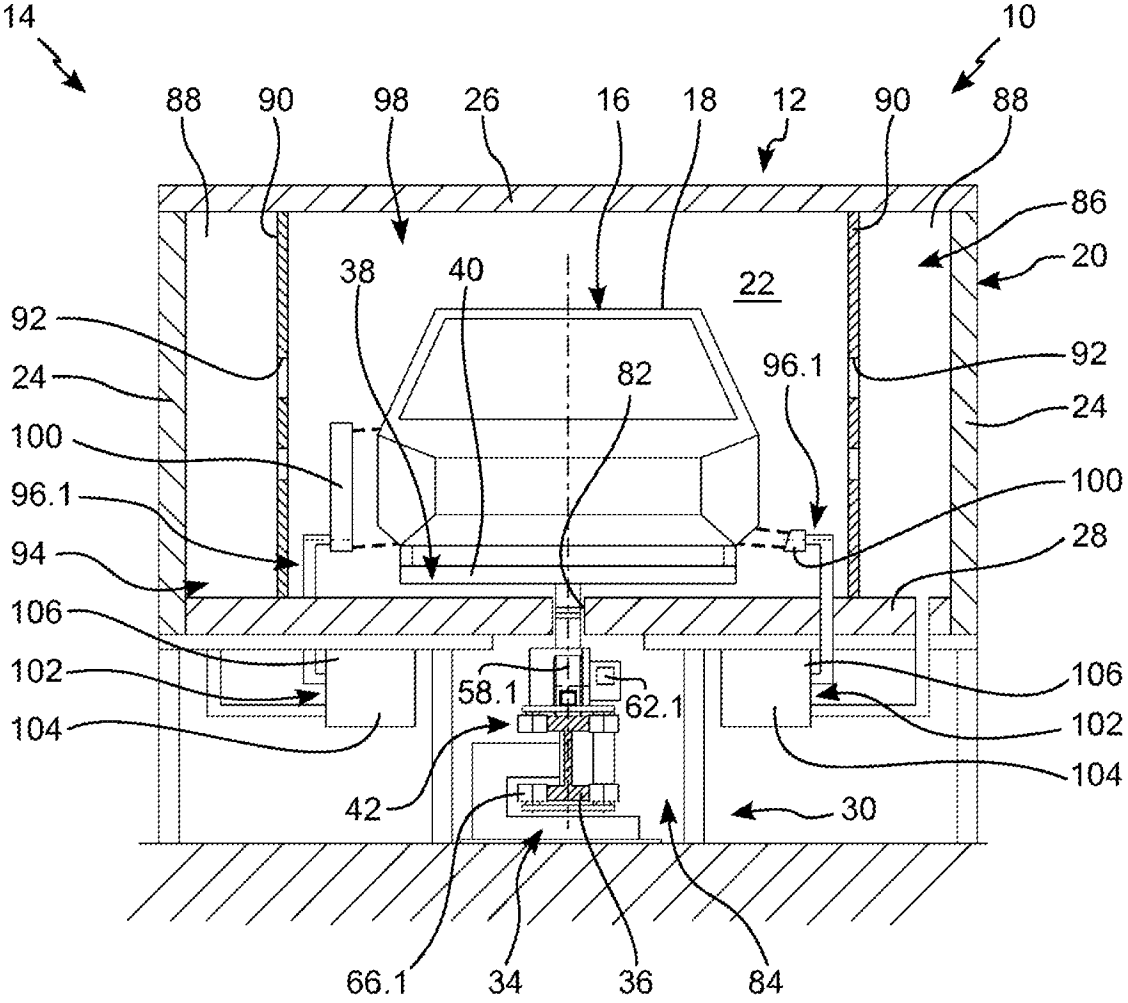
FIG. 3 shows a first cross section of the drying cabin as per FIG. 1 in a first cabin portion, wherein, apart from the full-space temperature-controlling installation, two first local temperature-controlling units of the local temperature-controlling installation having a first mode of action are shown.

FIG. 3 now shows in each case one first local temperature-controlling unit 96.1 on both sides of the vehicle body 18, said first local temperature-controlling unit 96.1 being adapted to drying the sill region 18*a* and the lower part of the region 18*b* of the B pillar of the vehicle body 18. The first local temperature-controlling units 96.1 in the case of the present exemplary embodiment are disposed so as to be stationary in the drying cabin 12.

To this end, such a first local temperature-controlling unit 96.1 comprises an elongate nozzle strip 100 which at one end region is pivotably coupled to an air supply installation 102 such that the nozzle strip 100 can be selectively aligned horizontally, vertically, or optionally also in an inclined manner, this being again visualized in FIG. 3A.

The air supply installation 102 is aerodynamically connected to the air space 88 such that air from the air space 88 is directed to the nozzle strip 100. The air supply installation 102 in the case of the present exemplary embodiment also comprises a blower 104 having an additional heating installation 106 such that the air can be effectively evacuated from the air space 88 and be separately heated once again. However, the blower 104 and/or the heating installation 106 can optionally also be dispensed with.

The local temperature-controlling units 98 are in principle in each case disposed in a symmetrical manner on both sides of the workpiece 16 in the drying tunnel, wherein this may be deviated from. For the sake of simplicity, FIGS. 4 and 5 however now show in each case local temperature-controlling units 96 which are dissimilar on the left and on the right, wherein local temperature-controlling units 96 of the same type are usually opposite one another.

Figure 4:
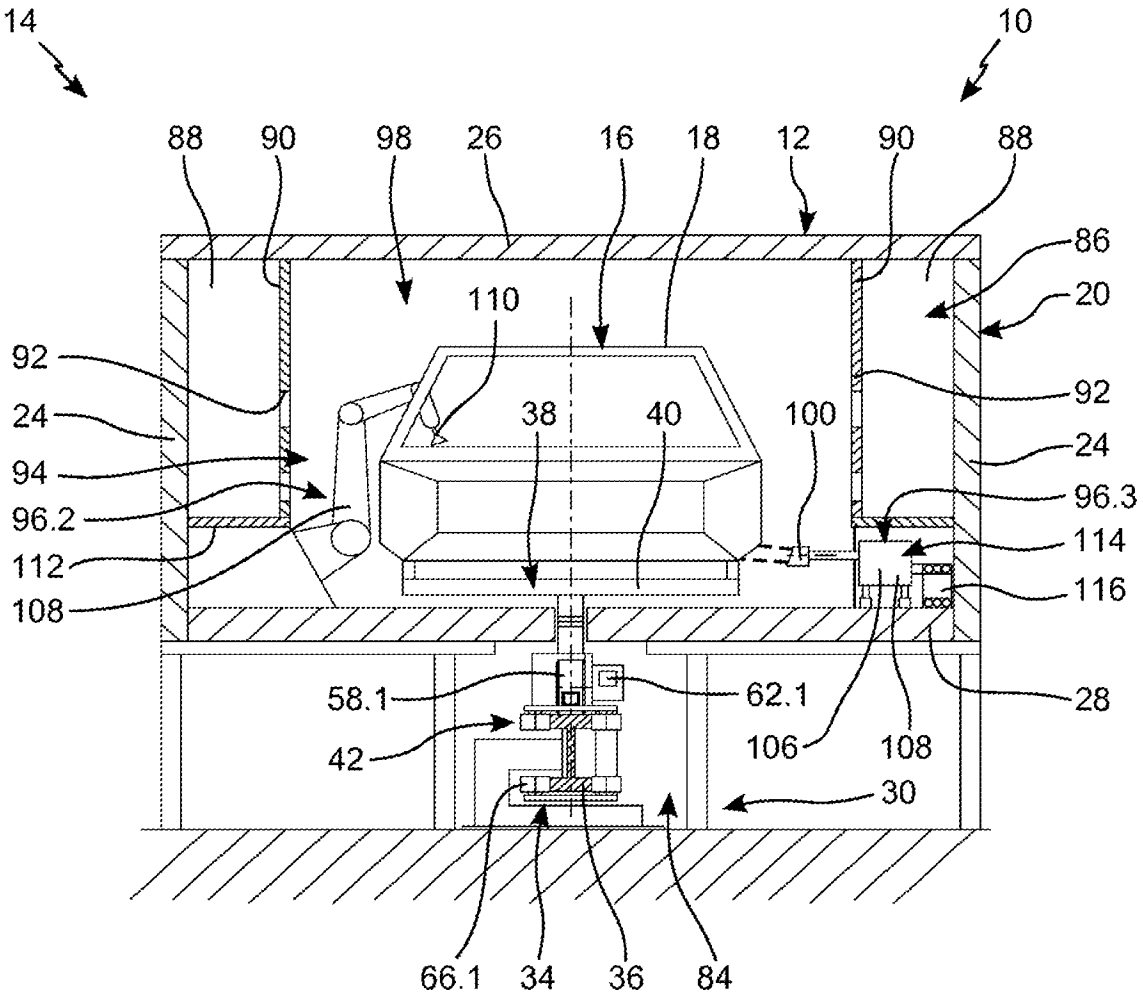
FIG. 4 shows a second cross section of the drying cabin as per FIG. 1 in the second cabin portion, wherein, apart from the full-space temperature controlling installation that is modified in this cabin portion, a second local temperature-controlling unit and a third local temperature-controlling unit are shown.

FIG. 4 in the left region of the painting cabin 12 in said figure shows a second local temperature-controlling unit 96.2, and in the right region in said figure a third local temperature-controlling unit 96.3.

The second local temperature-controlling unit 96.2 is a movable temperature-controlling units which here is present in the form of the multi-axis robotic arm 108 which supports an air nozzle 110 which is connected to the air space 88 by way of a line (not specifically shown). This movable temperature-controlling unit 96.2 can reach the interior of the vehicle body 18 by way of the window openings of the latter such that the temperatures of the mass-rich regions in the interior of the vehicle body 18 can also be effectively controlled. The robotic arm 108 herein can to a certain extent also follow a transporting movement of the vehicle body 18. However, the robotic arm 108 per se is anchored so as to be stationary in the painting cabin 12.

The mounting of the robotic arm 108 is performed on a pedestal (not provided with a dedicated reference sign) which is accommodated in a niche 112 provided therefor on the floor of the air space 88 and thus on the tunnel floor 28.

The third local temperature-controlling unit 96.3 is again conceived having a pivotable nozzle strip 100 for drying the sill region 18*a* or the region 18*b* of the B pillar, wherein the third local temperature-controlling unit 96.3 is repositionable in the longitudinal direction of the drying cabin 12. To this end, the nozzle strip 100 is supported by a support truck 114 which optionally also carries on board a blower 104 and/or a heating installation 106, as has been described in the context of the first local temperature-controlling unit 96.1. The third local temperature-controlling unit 96.3 is supplied with power and hot air by way of a supply line bundle that is guided as festoon system 116.

In this way, the mass-rich region of the vehicle body 18 to be dried can also be continuously impinged with hot air by the third local temperature-controlling unit 96.3 even in the movement of said mass-rich region of the vehicle body 18 in the drying tunnel 22.

Figure 5:
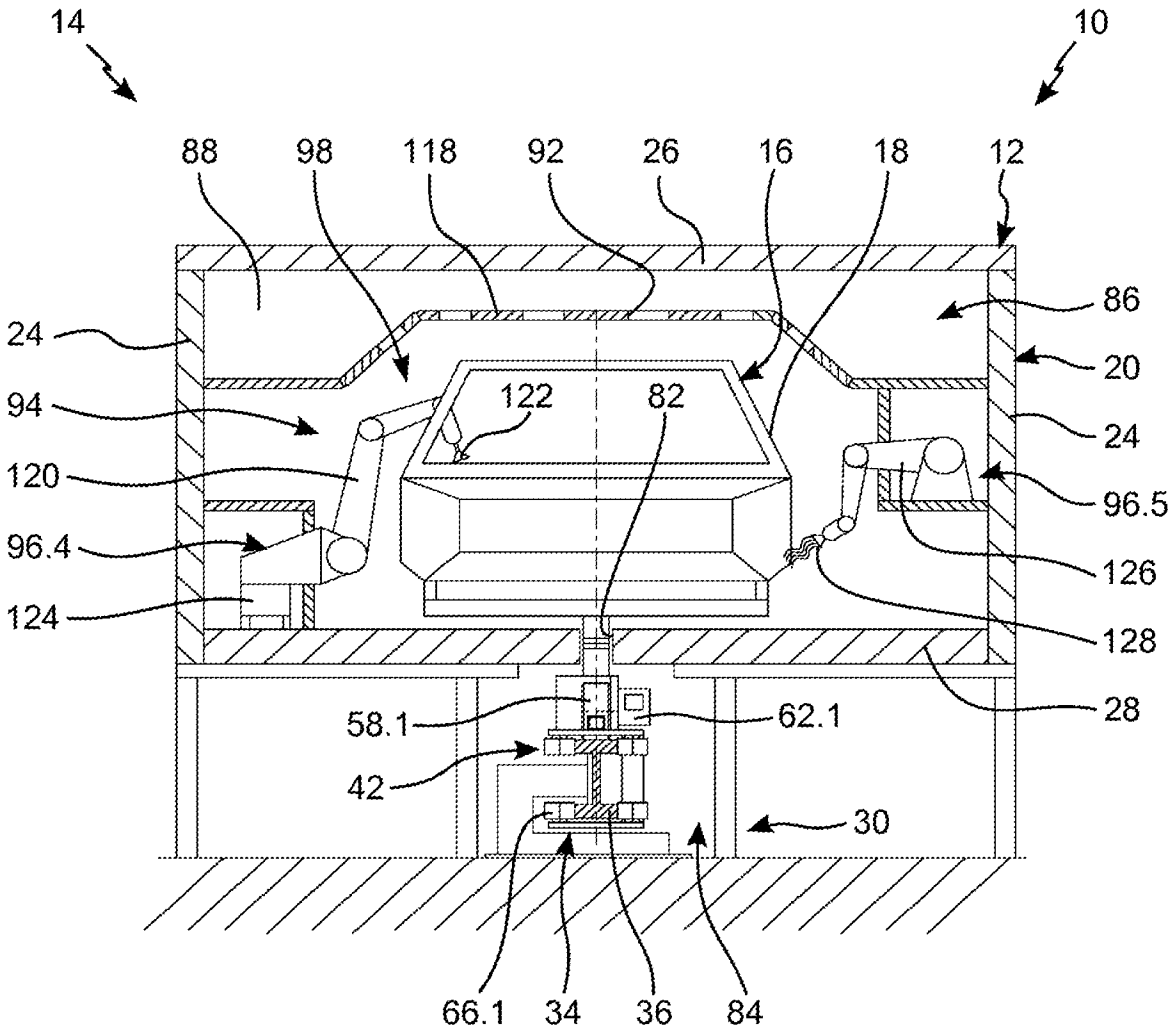
FIG. 5 shows a third cross section of the drying cabin as per FIG. 1 in a third cabin portion, wherein, apart from the full-space temperature-controlling installation that is modified yet once more in this cabin portion, a fourth local temperature-controlling unit and a fifth local temperature-controlling unit are shown.

FIG. 5 visualizes a portion of the painting cabin 12 in which the full-space temperature-controlling installation 86 is modified, and shows a fourth and fifth local temperature-controlling unit 96.4 and 96.5, respectively, which for visualization are in each case shown only on one side of the painting cabin 12.

The full-space temperature-controlling installation 86 in the case of this portion defines an air space 88 which is located below the ceiling 26 of the painting cabin 12 and is separated from the drying tunnel 22 by an intermediate ceiling 118 having the air passages 92.

The fourth local temperature-controlling unit 96.4 shown on the left in FIG. 5 is a robotic arm 120 which is repositionable in the longitudinal direction of the drying tunnel 22 and which guides an air nozzle 122. The robotic arm 120 is supported by a travelling pedestal 124 which with the aid of a drive (not specifically shown) can be repositioned in the longitudinal direction of the painting cabin 12 on the tunnel floor 28 of the painting cabin 12.

The fifth local temperature-controlling unit 96.5 which can be seen on the right in FIG. 5 is again a robotic arm 126 having an air nozzle 128 present, said robotic arm 126 in this case however being mounted so as to be stationary at mid-height of the drying tunnel 22.

Figure 6:
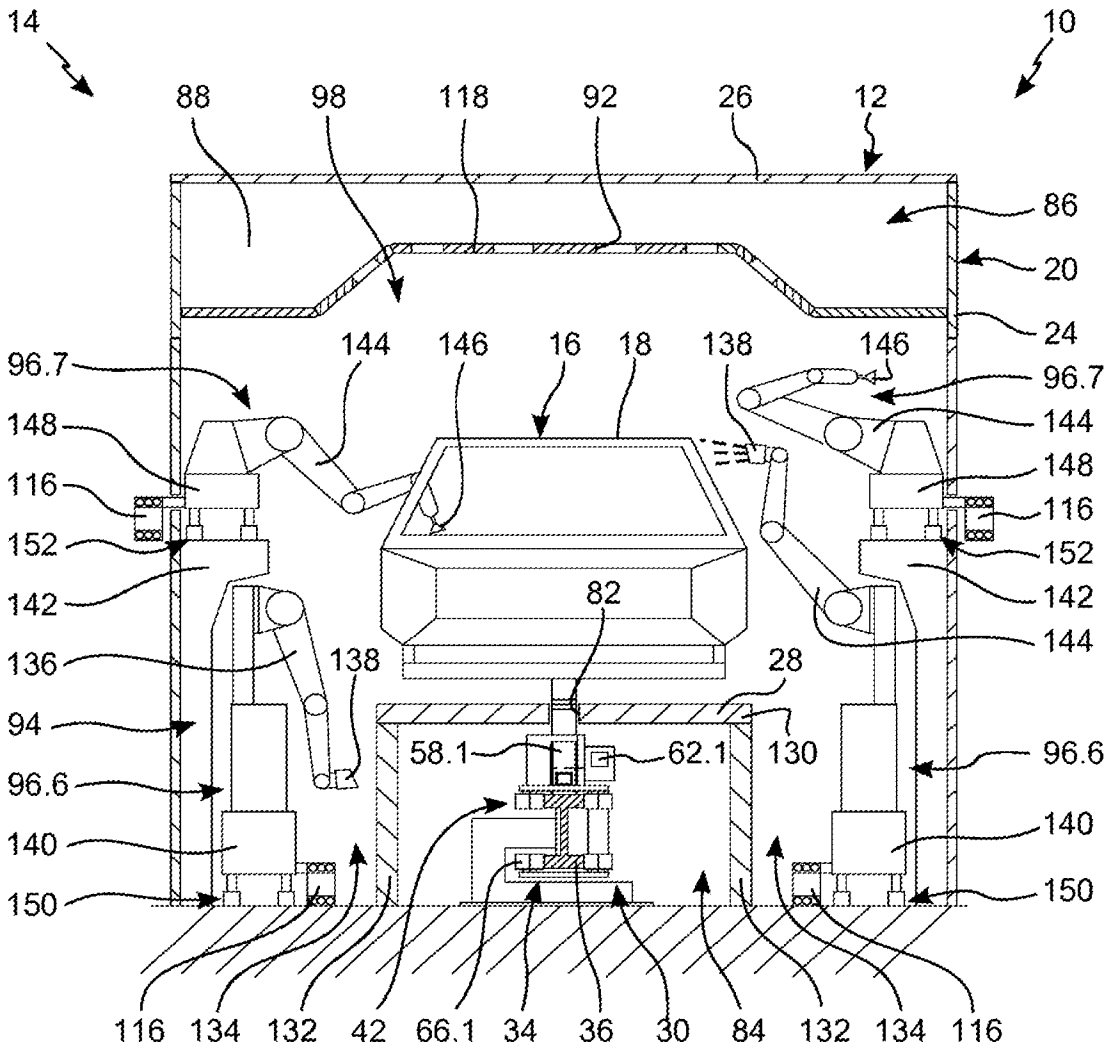
FIG. 6 shows a fourth cross section of the drying cabin as per FIG. 1 in a fourth cabin portion, wherein this cabin portion is reached by the full-space temperature-controlling installation in a passive manner, and a sixth local temperature-controlling device and a seventh local temperature-controlling device are shown in this cabin portion.

FIG. 6 shows a portion of the painting cabin having the modified full-space temperature-controlling installation 86 according to FIG. 5, wherein the full cross section of the painting cabin 12 is shown in FIG. 6 and not the different sides of different portions of the drying tunnel 22.

The running space 84 for the transport system 30 therein is limited by a tunnel floor portion 130 and two vertical walls 132 that run in the longitudinal direction of the painting cabin 12. Running ducts 134 for sixth local temperature-controlling units 96.6 are thus configured to the left and the right beside said walls 132 within the drying tunnel 22. These sixth local temperature-controlling units 96.6 are again configured as repositionable robotic arms 136 having the air nozzle 138, said robotic arms 136 being supported by a travelling pedestal 140. The supply is again in each case performed by way of a festoon system 116. The travelling pedestal 140 and the robotic arm 136 are mutually adapted such that the robotic arm 136 from the running duct 132 reaches all required regions of the vehicle body 18.

Travelling pedestals 142 on which seventh local temperature-controlling units 96.7 can be repositioned are configured above the robotic arms 136, approximately at mid-height of the drying tunnel 22, in the longitudinal direction on both sides of the drying tunnel 22. Said seventh local temperature-controlling units 96.7 comprise in each case likewise one robotic arm 144 having an air nozzle 146, said robotic arm 144 being supported by a travelling pedestal 148 and being supplied by means of a festoon system 116.

Figure 7:
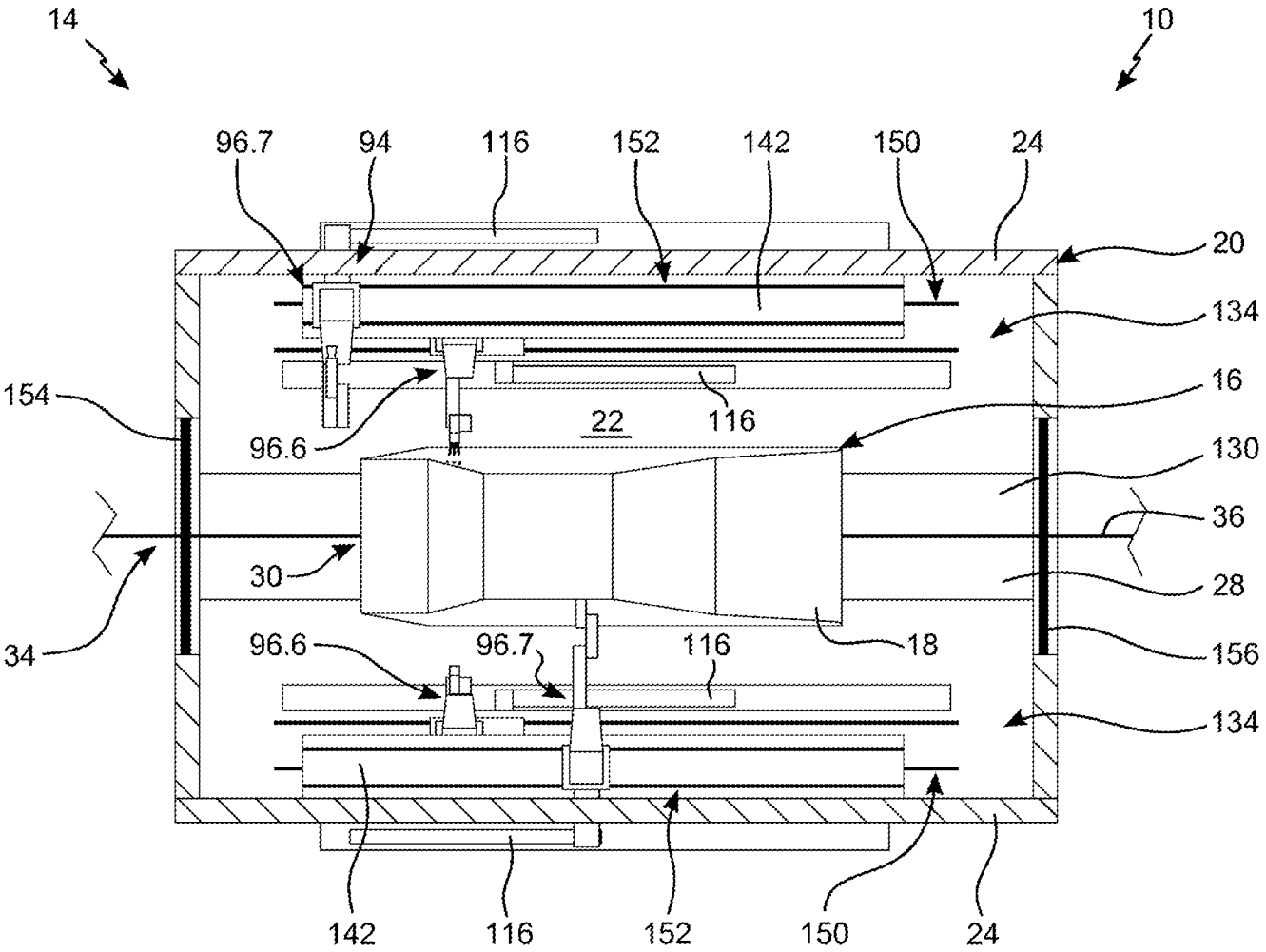
FIG. 7 shows a horizontal section of the fourth cross section as per FIG. 5.

FIG. 7 shows this portion of the painting cabin 12 in a plan view from above. As can be readily seen therein, the travelling pedestals 140 and 148 of the fifth and sixth local temperature-controlling units 96.5, 96.6, respectively, are in each case guided on the rails 150 and 152, respectively.

Figure 8:
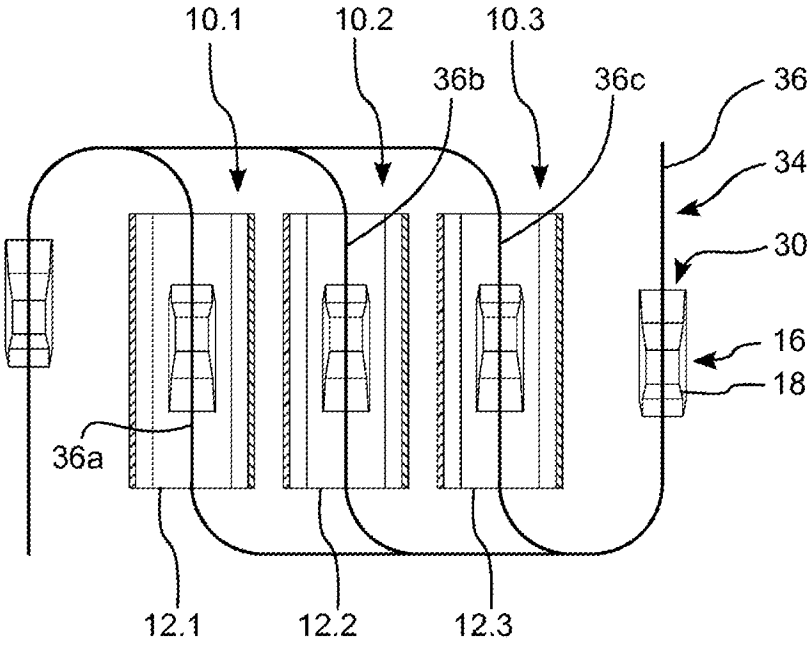
FIG. 8 shows a layout of the dryer having three individual cabins as per FIGS. 1 to 6.

FIG. 8 visualizes a part-layout of the system 14 in which a plurality of temperature-controlling devices 10, or drying cabins 12, respectively, can be approached selectively by a transport truck 32 loaded with a workpiece 16. Three temperature-controlling devices 10.1, 10.2, 10.3, or drying cabins 12.1, 12.2, 12.2, respectively, are shown in an exemplary manner, said temperature-controlling devices or drying cabins, respectively, being able to be approached in parallel and, on account thereof, in a mutually independent manner. To this end, the support rail 36 of the rail system 34 branches into three secondary branches 36*a*, 36*b*, 36*c*, of which each leads through one of the three drying cabins 12.1, 12.2, 12.3, wherein the secondary branches 36*a*, 36*b*, 36*b* are again converged.

Dissimilar workpieces 16 which require different drying procedures having in each case dedicated total drying times can in this way be individually treated in one of the drying cabins 12.1, 12.2, 12.3. When one drying cabin 12 is occupied, a vacant drying cabin 12 is approached. The coordination of the transport trucks 32 herein is performed by way of the respective control unit 80 which optionally interact with a superordinate central controller (not specifically shown here). For example, different drying procedures and drying times can result by way of dissimilar coatings of the workpieces 16. For example, a base coat requires another drying procedure than a cover coat or a filler. In principle, each drying cabin 12 is specified for controlling the temperature of different workpieces 16 having dissimilar coatings.

The existing drying cabins 12 can also be adapted to controlling the temperature of specific coatings and have dissimilar temperature-controlling units 96, and be specialized for treating a base coat and a cover coat, for example.

Figure 9:
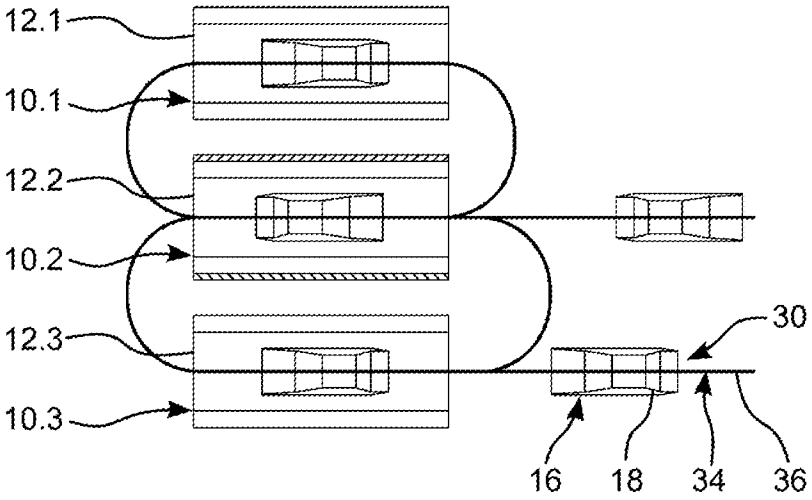
FIG. 9 shows a modified layout of a dryer having three individual cabins as per FIGS. 1 to 6.

FIG. 9 shows a part-layout of the system 14, in which a plurality of temperature-controlling devices 10, or drying cabins 12, respectively, are disposed in a row and are linked to one another by the rail system 34 and the support rail 36. Dissimilar drying procedures which are optionally required can thus be passed by a workpiece 16 in a temporal sequence.

The local temperature-controlling units 96 in the case of all exemplary embodiments explained above are equipped with an air nozzle for hot air. In the case of modifications (not specifically shown) heat radiators can also be provided instead of the air nozzles, said heat radiators emitting a thermal radiation onto the workpiece 16 such that the temperatures of local regions of the workpiece 16 can be controlled in a targeted manner.

Heat radiators in this instance are not connected by way of supply lines for temperature-controlled air, but by way of supply lines by way of which the heat radiators can be supplied with the resources which are required for the operation of said heat radiators. Infrared heaters which have to be supplied with electric power, and dark radiators which generate the heat by combusting an oxygen/gas mixture which has to be supplied to said dark radiators in a corresponding manner, are in particular provided as heat radiators. Heat radiators can be operated at dissimilar outputs such that the quantity of heat per unit of time that is emitted by a heat radiator can be adjusted.

The drying cabins 12 in the case of the exemplary embodiments explained above are conceived as a continuous cabin, and the respective drying tunnel 22 is thus conceived as a continuous tunnel having an entry 154 at one end and an exit 156 at the opposite end, said entry 154 and exit 156 are to be seen only in FIG. 7. The entry 154 and the exit 156 in a manner known per se are optionally configured as locks or as a door.

In the case of a modification (not specifically shown), the drying cabin 12 can be configured as a batch cabin having only a single entry and exit, into which the workpieces 16 with the aid of the transport system 30 are conveyed through the entry and exit, and after the completion of the drying procedure are again conveyed out of by way of the entry and exit. This entry and exit can optionally also be configured as a lock.

The transport system 30 enables a workpiece 16 to be able to be moved in the transport direction 44, or else counter to the transport direction 44, within the drying tunnel 22. In this way, a workpiece 16 can also always be moved in both directions relative to a local temperature-controlling unit 96, such that individual drying procedures for each workpiece 16 can be adapted in even a fine manner.

In principle, it is thus possible that there are only stationary local temperature-controlling units 96 which can heat only a limited region. On account of the flexibility of the transport system 30 the workpieces 16 and the regions thereof to be dried can then by way of a plurality of reciprocating movements also be repeatedly guided past one or a plurality of such stationary local temperature-controlled units 96, respectively.

What is claimed is:

1. A device for controlling the temperature of workpieces comprising:

a) a housing;

b) a temperature-controlling tunnel accommodated in the housing;

c) a temperature-controlling system for controlling a temperature of workpieces, wherein d) the temperature-controlling system comprises da) a full-space temperature-controlling installation comprising a plurality of air passages through which air is provided to control the temperature of a workpiece as an entity;

db) a local temperature-controlling installation by means of which the temperatures of locally delimited regions of the workpieces are capable of being controlled in a targeted manner, said local temperature-controlling installation comprising a plurality of temperature-controlling units that are capable of being activated and actuated in a mutually independent manner, each temperature-controlling unit comprising at least one air directing element through which air is provided;

wherein e) the full-space temperature-controlling installation and the local temperature-controlling installation are provided in the temperature-controlling tunnel in such a manner that, at least within a portion of the temperature-controlling tunnel, the plurality of air passages and at least one air directing element both extend laterally along the portion of the temperature-controlling tunnel and simultaneously direct air at and control the temperature of the workpiece.

2. The device as claimed in claim 1, wherein the full-space temperature-controlling installation comprises at least one air space which is separated from the temperature-controlling tunnel by way of a wall having air passages, wherein air is capable of being blown into the temperature-controlling tunnel from the at least one air space.

3. The device as claimed in claim 2, wherein an air space is disposed laterally beside the temperature-controlling tunnel, or two air spaces are disposed on both sides beside the temperature-controlling tunnel, and/or an air space is disposed above the temperature-controlling tunnel.

4. The device as claimed in claim 1, wherein the local temperature-controlling installation comprises stationary temperature-controlling units and/or repositionable temperature-controlling units.

5. The device as claimed in claim 4, wherein the at least one movable temperature-controlling unit comprises a pivotable nozzle strip and/or at least one movable temperature-controlling unit comprises a robotic arm.

6. The device as claimed in claim 5, wherein the robotic arm supports an air nozzle.

7. The device as claimed in claim 1, wherein at least one of the temperature-controlling units of the local temperature-controlling installation is movable such that a main jet direction thereof is adjustable.

8. A system for controlling the temperature of workpieces comprising: at least one device as claimed in claim 1.

9. The system as claimed in claim 8, further comprising a transport system which comprises a multiplicity of transport trucks which are repositionable on a rail system and by means of which the workpieces are capable of being transported in or through the temperature-controlling tunnel, wherein each transport truck comprises a transport-truck running gear and a fastening installation for at least one workpiece, said transport-truck running gear and said fastening installation being coupled to one another by means of a connection installation.

10. The system as claimed in claim 9, wherein the temperature-controlling tunnel has a tunnel floor having a connection passage, and a running space, disposed below the temperature-controlling tunnel, for the transport-truck running gear is present in such a manner that the transport-truck running gear is movable in the running space, wherein the fastening installation is carried onboard in the temperature-controlling tunnel, and the connection installation extends through the connection passage.

11. The system as claimed in claim 8, wherein the transport trucks carry onboard a dedicated drive system such that the transport trucks are capable of being driven and repositioned in a mutually independent manner.

12. The system as claimed in claim 11, wherein the transport trucks carry onboard an autonomous power supply installation by means of which the drive system is capable of being supplied with power.

13. The system as claimed in claim 8, wherein at least two devices as claimed in claim 1 are linked in parallel or in series by the transport system.

14. A method for controlling the temperature of workpieces comprising:

controlling the temperature of workpieces simultaneously at least in a portion of a temperature-controlling tunnel both by providing a full-space temperature-controlling installation comprising a plurality of air passages through which air is provided which controls the temperature of a workpiece as an entity, and by providing a local temperature-controlling installation comprising a plurality of temperature-controlling units each comprising at least one air directing element through which air is provided for controlling the temperatures of locally delimited regions of the workpieces in a targeted manner, said plurality of temperature-controlling units which are capable of being activated and actuated in a mutually independent manner and extending both of said plurality of air passages and at least one air directing unit laterally along the portion of the temperature-controlling tunnel.

* * * * *